United States Patent [19]

Hyltin

[11] 3,982,089

[45] Sept. 21, 1976

[54] PUSHBUTTON SWITCH

[75] Inventor: Tom M. Hyltin, Dallas, Tex.

[73] Assignee: Seiko Instruments Incorporated, Torrance, Calif.

[22] Filed: Nov. 29, 1974

[21] Appl. No.: 528,230

[52] U.S. Cl. ..... 200/159 B; 200/159 A; 200/302

[51] Int. Cl.[2] ..... H01H 3/12

[58] Field of Search ..... 200/159 R, 159 A, 159 B, 200/302, 296, 16 R, 16 A, 16 B, 16 C, 16 D, 16 E; 58/50 R, 90 R

[56] References Cited

UNITED STATES PATENTS

| | | | |
|---|---|---|---|
| 2,262,777 | 11/1941 | Roper | 200/159 B |
| 3,238,344 | 3/1966 | Miachon | 200/302 |
| 3,767,875 | 10/1973 | Schneikart et al. | 200/159 B |
| 3,783,607 | 1/1974 | Feurer | 58/90 B |

*Primary Examiner*—Robert K. Schaefer
*Assistant Examiner*—Morris Ginsburg
*Attorney, Agent, or Firm*—Brumbaugh, Graves, Donohue & Raymond

[57] ABSTRACT

A pushbutton switch for electronic devices such as watches includes a housing provided with a cavity. A first electrically conducting contact member is mounted within the cavity on an electrically insulating portion of the housing. A diaphragm extends across and seals the cavity. A second resilient electrically conducting contact member is mounted between the first contact member and the diaphragm on an electrically conducting portion of the housing. The first contact member extends through the electrically insulating portion of the housing for forming one terminal of the switch while the electrically conducting portion of the housing forms the other terminal. Depressing the diaphragm deflects the second contact member into contact with the first contact member for electrically connecting the terminals to close the switch.

7 Claims, 2 Drawing Figures

PUSHBUTTON SWITCH

BACKGROUND OF THE INVENTION

Solid state electronic technology introduced an incredible reduction in the size of elecronic devices over that of even the tiniest conventional devices. The advent of integrated circuit technology now permits whole circuits to be placed on a thumb-nail sized wafer while complex systems fit on a wafer only an inch or two in diameter. With this incredible reduction in the size of electronic components, manual interfacing devices such as the keys of a pocket calculator are often the devices which limit the practical size of apparatus on which they are used.

In an effort to overcome the size limitations of these manual interfacing devices, it is desirable to improve their electro-mechanical structure so as to reduce their size. These efforts are often blocked by a dramatic increase in cost and difficulty of assembling these small devices.

Examples of apparatus for which it is particularly desirable to reduce the size of manual interaction devices such as switches are electronic watches, subminiaturized calculators, and physiological monitoring equipment. These increasingly popular items must be small to meet their inherent requirements. In the case of watches, their size is further restricted by their competition with the highly developed art of mechanical watchmaking. Competition with mechanical watches also requires that electronic watches be made water resistant, since electronic devices, like mechanical watchworks, are subject to moisture degradation.

One advantage of electronic over mechanical watches is the ability to incorporate additional functions in the electronics of the watch with relatively little increase in the cost of the electronics. For example, watches incorporating date or stop-watch functions may be desired. These additional functions may require switching from the normal time function of the watch to display the additional function. In addition, even electronic watches occasionally need resetting which again requires switching of the time function. Finally, the display of each function of an electronic watch often requires a substantial portion of the power required for operating the watch; therefore, to maximize the life of the power supply for the watch, electronic watches often have switches for activating their function displays only when required.

One prior effort suitable for providing a switch for an electronic watch is shown in U.S. Pat. No. 3,783,607 issued Jan. 8, 1974, in the name of W. A. Feurer. This patent shows a sleeve housing holding a headed actuator. A spring is coiled about a stem of the actuator from a base of the housing to the head of the actuator for resiliently urging the actuator outwardly of the housing. The stem extends through the base of the housing and has a flange outside the housing for retaining the actuator in the housing. A ring gasket extends about the head of the actuator and engages the sleeve of the housing for sealing the arrangement. Not only does this device require inserting the necessarily small actuator within the housing against the action of the spring and the subsequent addition of the flange for retaining the assembly, but it also depends upon the sliding engagement of the ring gasket with the sleeve for retaining its water resistance.

SUMMARY OF THE INVENTION

The invention relates to a pushbutton switch suitable for use with integrated circuits as, for example, in an electronic watch. It is an object of the invention to provide a switch which is small yet easily assembled. It is an additional object to provide a switch which is sealed.

A pushbutton switch suitable for miniaturized electronic devices is formed by a housing provided with a sealed cavity communicating with an electrically insulating portion of the housing. A first electrically conducting contact member is mounted on the insulating portion of the housing in the cavity. A flexible diaphragm extends across the housing and seals the cavity. A second resilient and electrically conducting contact member is mounted on the housing between the first contact member and the diaphragm, and in spaced alignment with the first contact member for a normally open switch. Depressing the diaphragm deflects the second contact member into contact with the first contact member for electrically connecting the contact member to close the switch. Upon release of the diaphragm, the resilience of the second contact member returns it to its original position for opening the switch.

DESCRIPTION OF THE DRAWINGS

Preferred embodiments illustrative of the invention will now be described with reference to drawings in which.

DESCRIPTION OF THE PREFERRED EMBODIMENTS

Figure 1:
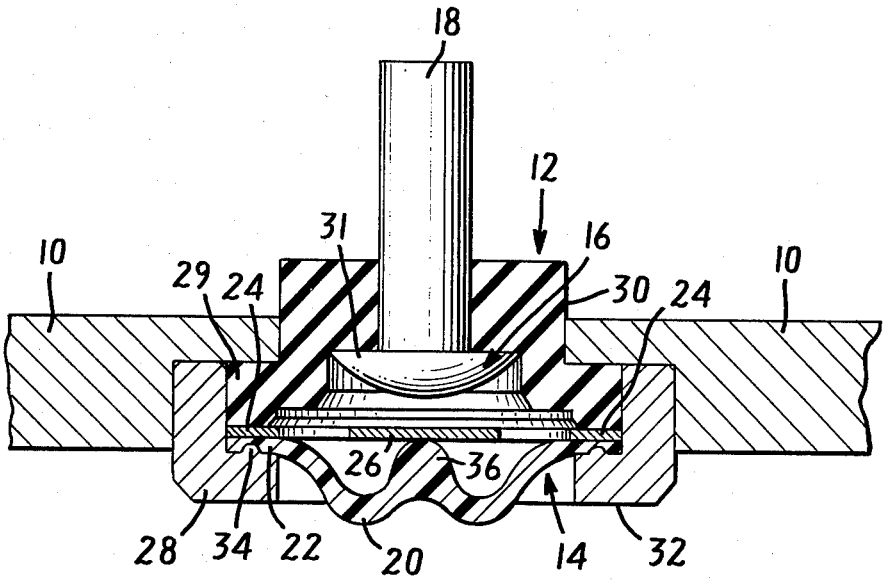
FIG. 1 is an enlarged, sectional elevation of one embodiment.

The preferred embodiment shown is intended for use on an electronic watch. In this typical embodiment, the switch is mounted on a case 10 of the watch which encloses the electronic watchworks (not shown) above a lower portion of the case shown in FIG. 1. The switch has a generally cylindrical housing at 12 extending through a hole in the case toward the watchworks. The housing has an opening or cavity at 14 extending into the housing from the outside of the case.

A first electrically conducting contact member at 16 is mounted on the housing with a portion 18 of the contact member extending into the interior of the case for forming one terminal of the switch for electrical connection to the electronic watchworks. A flexible diaphragm 20 seals the cavity in the housing with edges 22 of the diaphragm sealed to the housing. A second electrically conducting contact member 24 is mounted on the housing adjacent the edge portions of the diaphragm. An electrically conducting portion 28 of the housing engages the second contact member 24 for forming the other terminal of the switch. The portion 28 engages the watch case 10 to connect the contact member 24 electrically to the watch case 10.

A resilient tongue 26 of the second contact member is positioned in spaced alignment with the first contact member 16. Depressing the diaphragm then deflects the tongue into contact with the first contact member for closing the switch to electrically connect the watchworks to the case. The case forms a reference ground potential of the electronic watchworks and the watchworks respond to grounding of a portion of the works to perform a desired function such as displaying the date.

Examining the structure in greater detail, the electrically conducting portion 28 of the housing is force-fitted into a counterbored hole in the case to hold and seal the switch to the case. An electrically insulating portion 30 of the housing is force-fitted through a narrowed part of the hole in the case 10 to additionally seal the case about the housing. An annular flange 32 of the electrically conducting portion 28 of the housing overlaps a flange 29 of the electrically insulating portion of the housing. The peripheral edge portions 22 of the diaphragm 20 and the second contact member 24 are held between the flanges of the housing portions for mounting the diaphragm and the second contact member on the housing when the housing members are fitted into the case. The holding engagement of the flanges on the diaphragm 20 and contact member 24 also seals the diaphragm to the housing for sealing the switch with the diaphragm. A bead 34 extends about the flange 32 on a side facing the flange 29 for more firmly holding and sealing the diaphragm with the flanges of the housing.

The first contact member 16 is generally configured like a cylindrical, sub-miniature rivet. A head 31 of the member is positioned against the electrically insulating portion 30 of the housing. A shaft of the rivet is force-fitted through the housing portion 30 for mounting the contact on the housing portion and for forming the terminal 18 of the first contact.

The flexible diaphragm 20 is preferably formed from a resilient plastic. The bead 34 on the flange of the electrically conducting portion 28 of the housing deforms the diaphragm to improve the sealing of the diaphragm to the housing. From the peripherial portions of the diaphragm engaged by the bead 34, the diaphragm has a generally u-shaped, cross section forming an actuating hub 36 at the center of the diaphragm. The hub 36 rests against the tongue 26 of the second contact member in the normal, undepressed position of the diaphragm.

Figure 2:
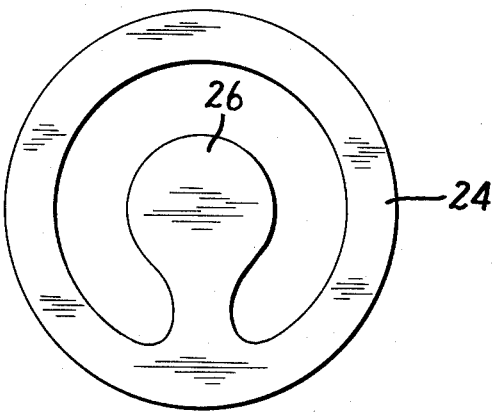
FIG. 2 is a plan view of a portion of the embodiment shown in FIG. 1.

The peripherial portion of the second generally annular contact member 24, which is held between the flanges 29, 32 of the housing, extends into engagement with the electrically conducting portion 28 of the housing which then forms the other terminal of the switch and electrically connects the second contact member to the case. As shown in FIG. 2, the second contact member 24 is generally annular with the central void of the annulus substantially corresponding to the opening 14 in the housing. The tongue 26 extends from the inner periphery of the annulus member into the void to provide the resilient contact which rests against the central hub of the diaphragm and is in spaced alignment with the contact head 31 of the first contact member.

Depressing the diaphragm, either with the finger or a blunt tool such as a pencil or ballpoint pen, then deflects the tongue 26 into contact with the first contact member. With the connection of the first contact member to the electronic watchworks (not shown), the watchworks are then connected through the first contact member, second contact member, and electrically conducting portion of the housing to the case of the watch. Upon release of the diaphragm, the resilient tongue 26 of the second contact member springs away from the first contact member and returns to the position shown in FIG. 1 for breaking the electrical connection of the contact members. The returning movement of the tongue 26 also pushes the hub 36 of the diaphragm back to the position shown in FIG. 1 to return the switch to its illustrated open condition.

I claim:

1. A pushbutton switch adapted to be sealably mounted in an aperture of a casing, the switch comprising a housing including an outer conductive portion, an inner insulating portion, and a cavity in the housing; a flexible diaphragm enclosing the cavity and adapted to be accessible from outside the housing and casing, peripheral portions of the diaphragm being engaged by the housing to seal the cavity in the housing; a first electrically conducting contact member within the cavity and extending through the insulating portion of the housing into the casing; and a second electrically conducting contact member mounted between the housing portions with a resilient portion within the cavity between the first contact member and the diaphragm so that depressing the diaphragm moves the second contact member into engagement with the first contact member to close the switch.

2. A pushbutton switch as set forth in claim 1, wherein the second electrically conducting contact member is generally annular with a resilient tongue portion extending from the perimeter of the cavity towards its center.

3. A pushbutton switch as set forth in claim 1, wherein the second electrically conducting contact member is electrically connected to the outer conductive portion of the housing.

4. A pushbutton switch adapted to be sealably mounted in an aperture of a casing, the switch comprising a generally cylindrical housing including an outer conducting portion, an inner insulating portion, and a cavity in the housing; a flexible diaphragm enclosing the cavity and adapted to be accessible from outside the housing and casing, peripheral portions of the diaphragm engaging the outer conducting housing portion to seal the cavity in the housing; a first electrically conducting contact member within the cavity and extending through the insulating portion of the housing into the casing; and a second generally annular electrically conducting contact member in the cavity and between the housing portions, the second member having a resilient tongue portion extending inwardly from its inner periphery and located between the first contact member and the diaphragm so that depressing the diaphragm moves the tongue portion into contact with the first contact member to close the switch.

5. The pushbutton switch as set forth in claim 4, wherein the second conducting member is electrically connected to said outer conducting housing portion.

6. A pushbutton switch in a case adapted for an electronic watch, the switch comprising a generally cylindrical housing including an outer electrically conducting portion engaging the case, an inner insulating portion extending into the case, the electrically conducting and insulating portions of the housing having overlapping flanges, and a cavity in the housing; a flexible diaphragm enclosing the cavity and adapted to be accessible from outside the housing and case, peripheral portions of the diaphragm being engaged between the flanges of the housing portions to seal the cavity in the housing; a first electrically conducting contact member having a contact head positioned within the cavity on the insulating portion of the housing and another portion extending through the insulating portion of the housing to form a switch terminal inside the case; and a second annular electrically conducting contact member having a resilient tongue portion extending inwardly from its inner periphery and having its outer periphery engaged between the flanges of the housing portions for mounting the second contact member within the cavity, the second contact member being electrically connected to the outer conducting portion of the housing by its engagement with the flange of the conducting portion of the housing, and the tongue portion being positioned between the first contact member and the diaphragm so that depressing the diaphragm moves the tongue portion into engagement with the head of the first contact member to close the switch and electrically connect the case to the switch terminal inside the case.

7. A pushbutton switch as set forth in claim 6, wherein the diaphragm is formed to have a W-shaped cross-section with the hub formed by the W engaging the resilient tongue portion.

* * * * *